US012252821B1

(12) United States Patent
Zhu et al.

(10) Patent No.: US 12,252,821 B1
(45) Date of Patent: Mar. 18, 2025

(54) HAND CROCHETING DEVICE AND HAND CROCHETING ASSEMBLY

(71) Applicant: Shenzhen Kaidu Linghang Technology Co., Ltd., Shenzhen (CN)

(72) Inventors: Shuijing Zhu, Changsha (CN); Fenfang Yao, Shenzhen (CN); Haixia Feng, Shenzhen (CN)

(73) Assignee: Shenzhen Kaidu Linghang Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/889,449

(22) Filed: Sep. 19, 2024

(30) Foreign Application Priority Data

Jun. 28, 2024 (CN) ..... 202421504895.8

(51) Int. Cl.
*D04B 33/00* (2006.01)

(52) U.S. Cl.
CPC ..... *D04B 33/00* (2013.01)

(58) Field of Classification Search
CPC ..... D04B 33/00; D04B 3/00; D04B 3/04
See application file for complete search history.

(56) References Cited

U.S. PATENT DOCUMENTS 1,577,658 A * 3/1926 Helen ..... D04B 3/00 242/150 R
2,434,609 A * 1/1948 Coffey ..... D04B 3/00 43/25
2,681,772 A * 6/1954 Charney ..... D04B 3/00 242/150 R

FOREIGN PATENT DOCUMENTS

GB 191300638 A * 10/1913 ..... D04B 33/00
GB 238924 A * 8/1925 ..... D04B 3/00
GB 426678 A * 4/1935 ..... D04B 3/00

* cited by examiner

*Primary Examiner* — Aiying Zhao
(74) *Attorney, Agent, or Firm* — SBPC&BMLaw

(57) ABSTRACT

A hand crocheting device and a hand crocheting are provided. The hand crocheting device includes a main body and an adjusting mechanism. The main body includes a first end and a second end. The adjusting mechanism is located at the second end. The adjusting mechanism includes a first clamping baffle fixed to the second end and a second clamping baffle facing the first clamping baffle. The first clamping baffle and the second clamping baffle cooperatively define a clamping slot for receiving a yarn. The second clamping baffle is movable relative to the first clamping baffle to adjust a size of the clamping slot, such that a tension on the yarn is adjustable.

16 Claims, 9 Drawing Sheets

FIG. 1(Related arts)

HAND CROCHETING DEVICE AND HAND CROCHETING ASSEMBLY

FIELD

The subject matter herein generally relates to crocheting, and more particularly, to a hand crocheting device and a hand crocheting assembly having the hand crocheting device.

BACKGROUND

When knitting and crocheting garments, stockings, and other articles, a user may hold a crocheting hook and draws the yarn from one hand to the other. In related arts shown in FIG. 1, the yarn from a ball of yarn is usually wrapped in one or more turns on a finger (e.g., the index finger) of the hand to maintain a desired tension on the yarn as the yarn is picked up by the crocheting hook to which the yarn is directed.

However, since the user uses the index finger to adjust the tension on the yarn, the user may feel pain due to repeated friction between the index finger and the yarn, and may also feel fatigue after maintaining a same posture for a long period. Furthermore, difficulty may be experienced in maintaining the desired tension on the yarn, which results in unevenness in the stitches. Therefore, there is a room for improvement in the art.

SUMMARY

A hand crocheting device is provided, which includes a main body and an adjusting mechanism. The main body includes a first end and a second end. The adjusting mechanism is located at the second end. The adjusting mechanism includes a first clamping baffle fixed to the second end and a second clamping baffle facing the first clamping baffle. The first clamping baffle and the second clamping baffle cooperatively define a clamping slot for receiving a yarn. The second clamping baffle is movable relative to the first clamping baffle to adjust a size of the clamping slot, such that a tension on the yarn is adjustable.

A hand crocheting assembly is further provided, which includes the hand crocheting device mentioned above and a crocheting hook.

Other aspects and embodiments of the present disclosure are also expected. The above summary and the following detailed description are not intended to limit the present disclosure to any particular embodiment, but are merely intended to describe some embodiments of the present disclosure.

BRIEF DESCRIPTION OF THE DRAWINGS

Implementations of the present technology will now be described, by way of embodiment, with reference to the attached figures.

DETAILED DESCRIPTION

Figure 1:
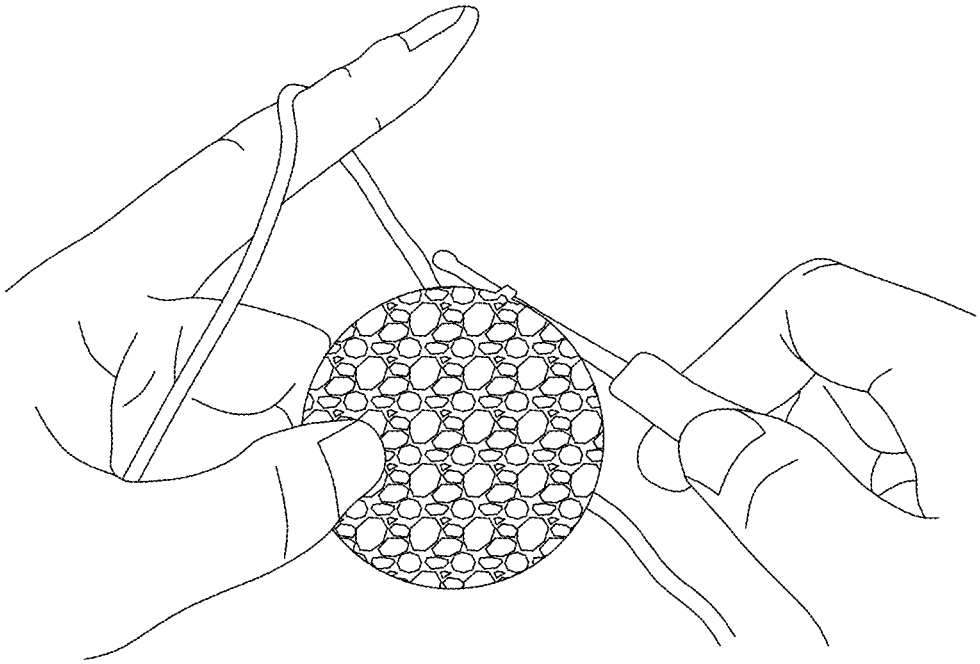
FIG. 1 is a diagrammatic view showing a yarn wrapped on an index finger during a crocheting process in related arts.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and members have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "comprising," when utilized, means "including, but not necessarily limited to"; it specifically indicates open-ended inclusion or membership in the so-described combination, group, series, and the like.

Referring to FIGS. 2 to 6, a hand crocheting device 100 is provided, which includes a main body 1 and an adjusting mechanism 2. The main body 1 may be substantially L-shaped, which includes a first portion 11 and a second portion 12 connected to the first portion 11. The first portion 11 extends along a first direction X, and the second portion 12 extends along a second direction Y perpendicular to the first direction X. The main body 1 further includes a first end 110 and a second end 120 opposite to the first end 110. The first end 110 is an end of the first portion 11 away from the second portion 12, and the second end 120 is an end of the second portion 12 away from the first portion 11.

The adjusting mechanism 2 is located at the second end 120 of the main body 1. The adjusting mechanism 2 includes a first clamping baffle 21 fixed to the second end 120 and a second clamping baffle 22 facing the first clamping baffle 21. The first clamping baffle 21 and the second clamping baffle 22 cooperatively define a clamping slot 23 therebetween, and a yarn may be partially received in the clamping slot 23 and clamped by the first clamping baffle 21 and the second clamping baffle 22. The second clamping baffle 22 is movable relative to the first clamping baffle 21 along the second direction Y, thereby adjusting a distance between the first clamping baffle 21 and the second clamping baffle 22. That is, a size of the clamping slot 23 is adjustable, such that clamping slot 23 may adapt to yarns with different thicknesses and control the tension on the yarn as needed. Compared to the existing technology that uses the index finger to hold the yarn and adjust the tension on the yarn, the clamping slot 23 of the present application may tightening the yarn to provide a desired tension on the yarn, thereby improving the evenness in the stitch results. Moreover, since the yarn may be held in the clamping slot 23, repeated friction between the index finger and the yarn may be avoided, and the index finger may not need to maintain a same posture during the crocheting process, thereby relieving the finger pain and fatigue to improve the crocheting experience.

Figure 5:
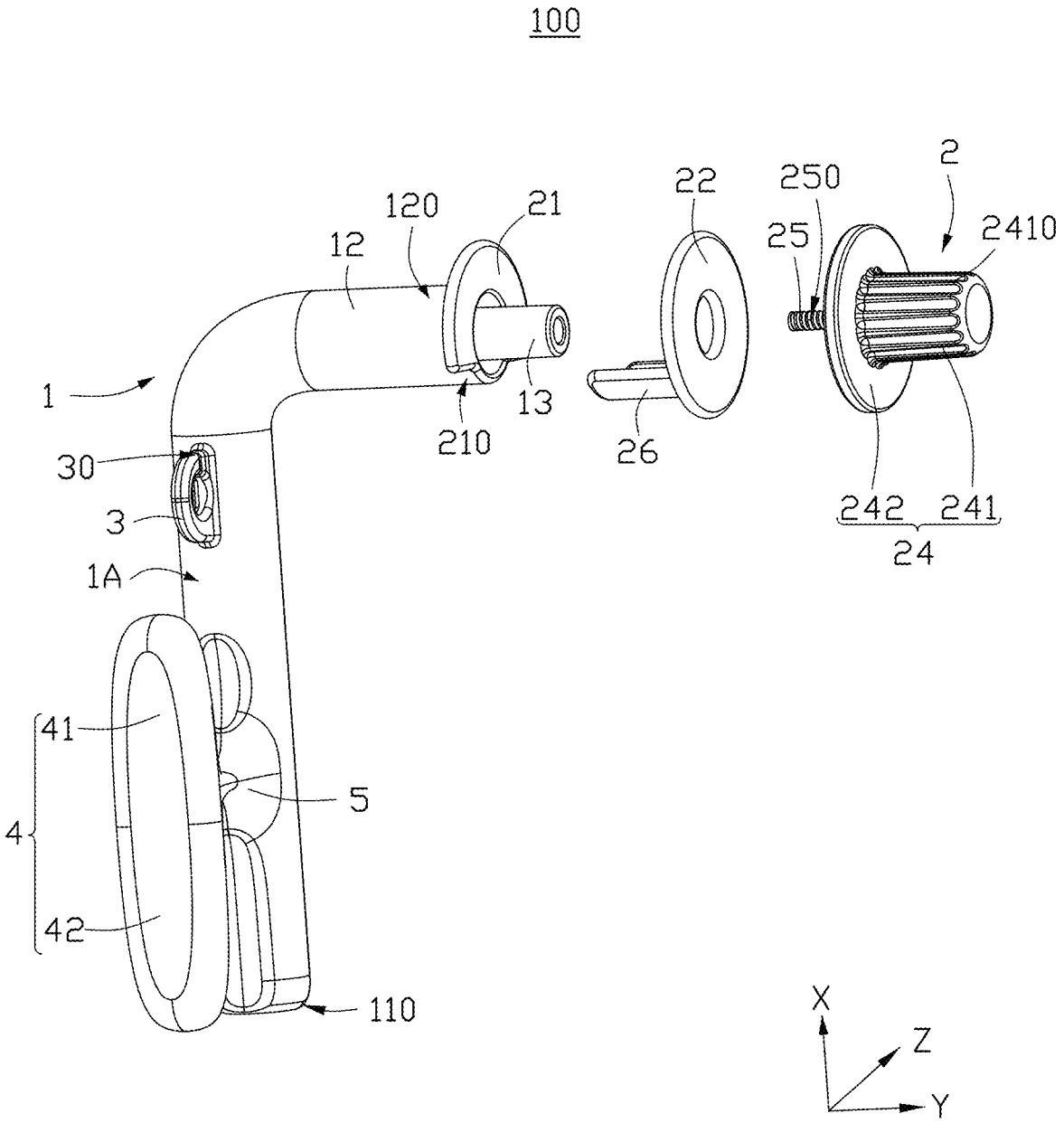
FIG. 5 is an exploded view of the hand crocheting device shown in FIG. 2.
Figure 6:
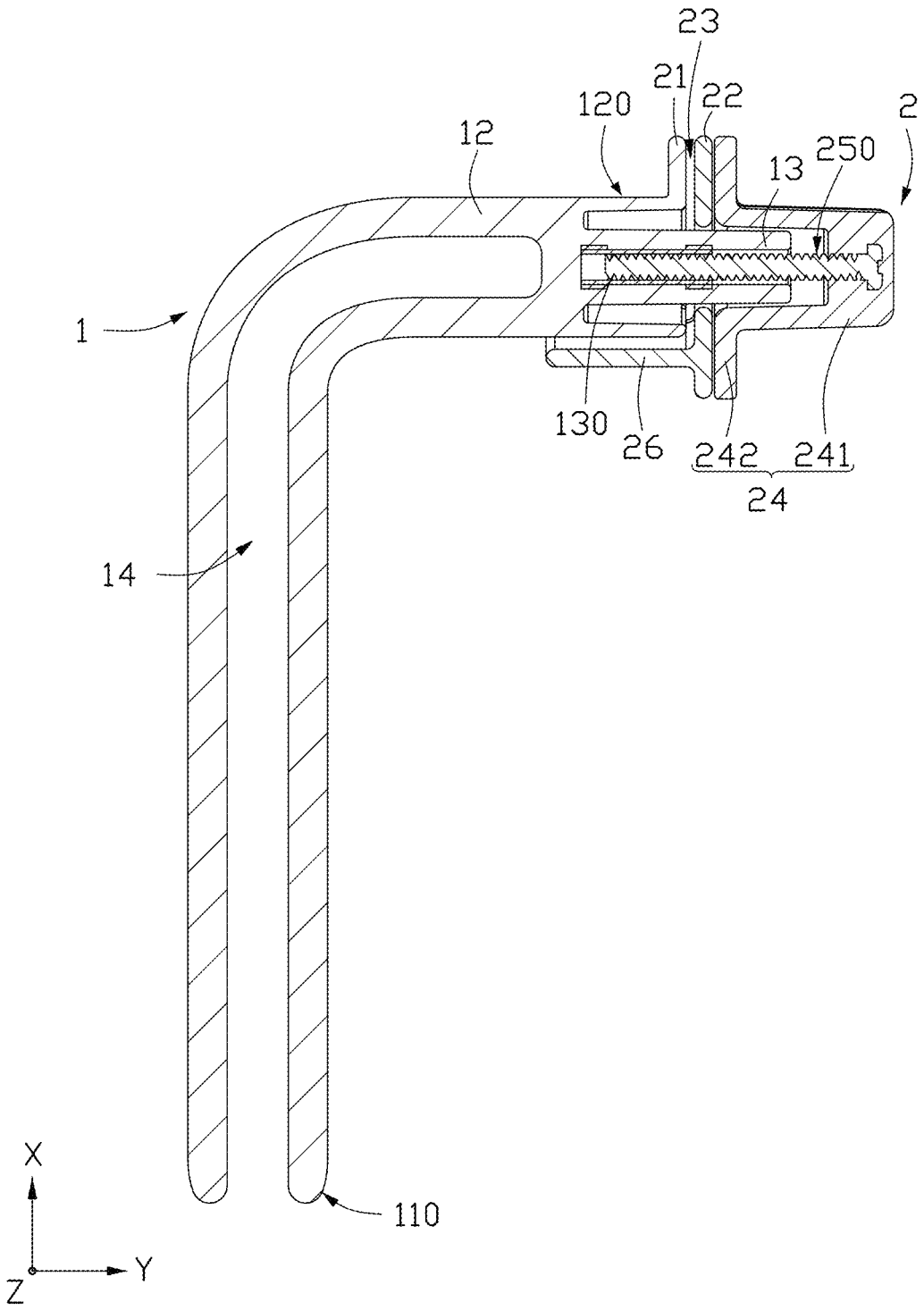
FIG. 6 is a cross-sectional view along VI-VI shown in FIG. 2.

Referring to FIGS. 5 and 6, in at least one embodiment, the main body 1 further includes a sleeve 13, which is received in the second end 120 of the main body 1 and protrudes from the second end 120 and the first clamping baffle 21. The sleeve 13 extends along the second direction Y. The sleeve 13 slidably extends through the second clamping baffle 22, thereby allowing the second clamping baffle 22 to slide along the sleeve 13, such that the second clamping baffle 22 is movable relative to the first clamping baffle 21. The adjusting mechanism 2 further includes a knob 24 and a screw rod 25 connected to the knob 24. The knob 24 is arranged at a side of the second clamping baffle 22 away from the first clamping baffle 21. The sleeve 13 further slidably extends through at least a portion of the knob 24. The sleeve 13 defines a first screw thread 130 on the inner surface of the sleeve 13, and the screw rod 25 defines a second screw thread 250 on the periphery of the screw rod 25. The first screw thread 130 may be engaged with the second screw thread 250, thereby allowing the screw rod 25 to be connected to the sleeve 13. When the knob 24 rotates relative to the second clamping baffle 22, the engagement between the first screw thread 130 and the second screw thread 250 drives the second clamping baffle 22 to slide along the second direction Y toward or away from the first clamping baffle 21, thereby adjusting the size of the clamping slot 23. In at least one embodiment, the knob 24 includes a cap portion 241 and a plate portion 242 connected to the cap portion 241. The screw rod 25 is connected to the cap portion 241, and further protrudes from the cap portion 241 and the plate portion 242. The plate portion 242 may abut against the second clamping baffle 22 when the knob 24 rotates relative to the second clamping baffle 22, and drive the second clamping baffle 22 to slide toward or away from the first clamping baffle 21. In at least one embodiment, when view from the second direction Y, the outer contour of each of the first clamping baffle 21, the second clamping baffle 22, and the knob 24 is substantially circular. In at least one embodiment, an outer surface of the cap portion 241 is provided with a number of ribs 2410, which may improve the anti-slip property of the knob 24 when a user rotates the knob 24. The ribs 2410 may be parallel to each other and extend along the second direction Y.

Furthermore, the first clamping baffle 21 defines a first cutout 210, and the first clamping baffle 21 with the first cutout 210 is substantially fan-shaped. The adjusting mechanism 2 further includes a third baffle 26, which is connected to a side of the second clamping baffle 22 facing the first clamping baffle 21. The third baffle 26 extends through the first cutout 210. The third baffle 26 may be abutted against the edge of the first cutout 210 along the rotation direction of the knob 24. Thus, when the knob 24 rotates and drives the second clamping baffle 22 to slide toward or away from the first clamping baffle 21, the first cutout 210 prevents the second clamping baffle 22 to rotate together with the knob 24, thereby allowing the first clamping baffle 21 and the second clamping baffle 22 to stably clamp the yarn in the clamping slot 23 and providing a stable tension on the yarn.

Figure 2:
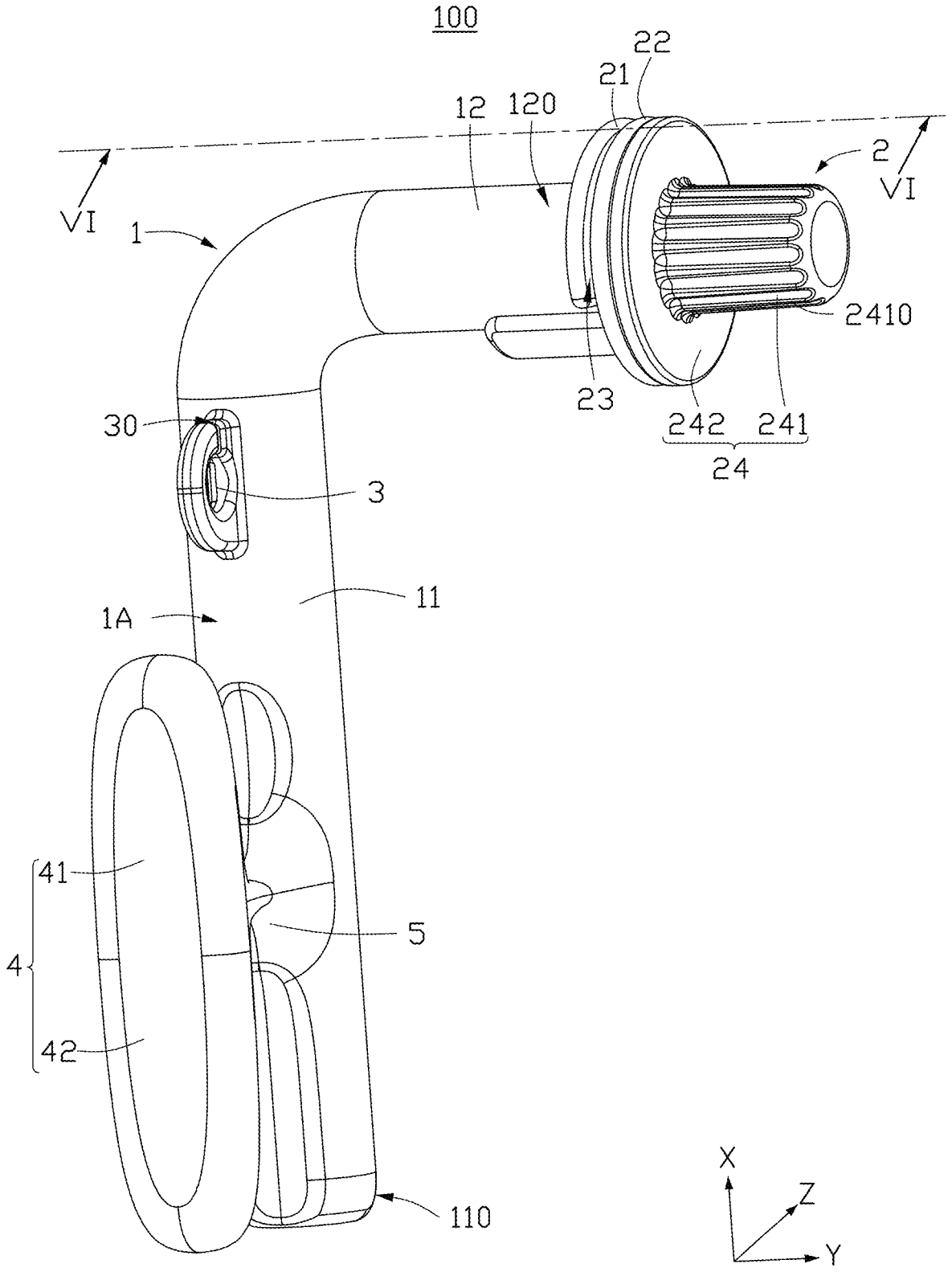
FIG. 2 is a diagrammatic view of a hand crocheting device according to an embodiment of the present application.

Referring to FIGS. 2, 5 and 6, in at least one embodiment, the hand crocheting device 100 further includes a guiding ring 3, which is connected to first portion 11 of the main body 1. The main body 1 further includes a first surface 1A and a second surface 1B connected to the first surface 1A. The first surface 1A and the second surface 1B are opposite to each other along a third direction Z, and the third direction Z is perpendicular to the first direction X and the second direction Y. When in use, in some embodiment, the first surface 1A is a front surface facing the user, and the second surface 1B is a rear surface opposite to the user. In other embodiments (for example, to make a magic circle), the first surface 1A is a rear surface facing the user, and the second surface 1B is a front surface opposite to the user. The guiding ring 3 is connected to the first surface 1A. When in use, the yarn tail sequentially extends through the guiding ring 3 and the clamping slot 23 (that is, the yarn tail is wrapped around the sleeve 13, and at this time, the yarn tail is located in the second surface 1B of the main body 1), and in some embodiment, the yarn tail further extends through the guiding ring 3 again (at this time, the yarn tail returns to the first surface 1A of the main body 1). At this time, the knob 24 may be rotated to drive the second clamping baffle 22 to slide toward the first clamping baffle 21, thereby tightening the yarn to provide a desired tension on the yarn tail. The guiding ring 3 may prevent the yarn from being tangled. In at least one embodiment, a side of the guiding ring 3 away from the first end 110 along the first direction X defines a second cutout 30. The yarn may be placed into the guiding ring 3 through the second cutout 30. In other embodiments, the second cutout may be omitted, and the yarn may be placed into the guiding ring 3 through the hole of the guiding ring 3 itself.

Figure 3:
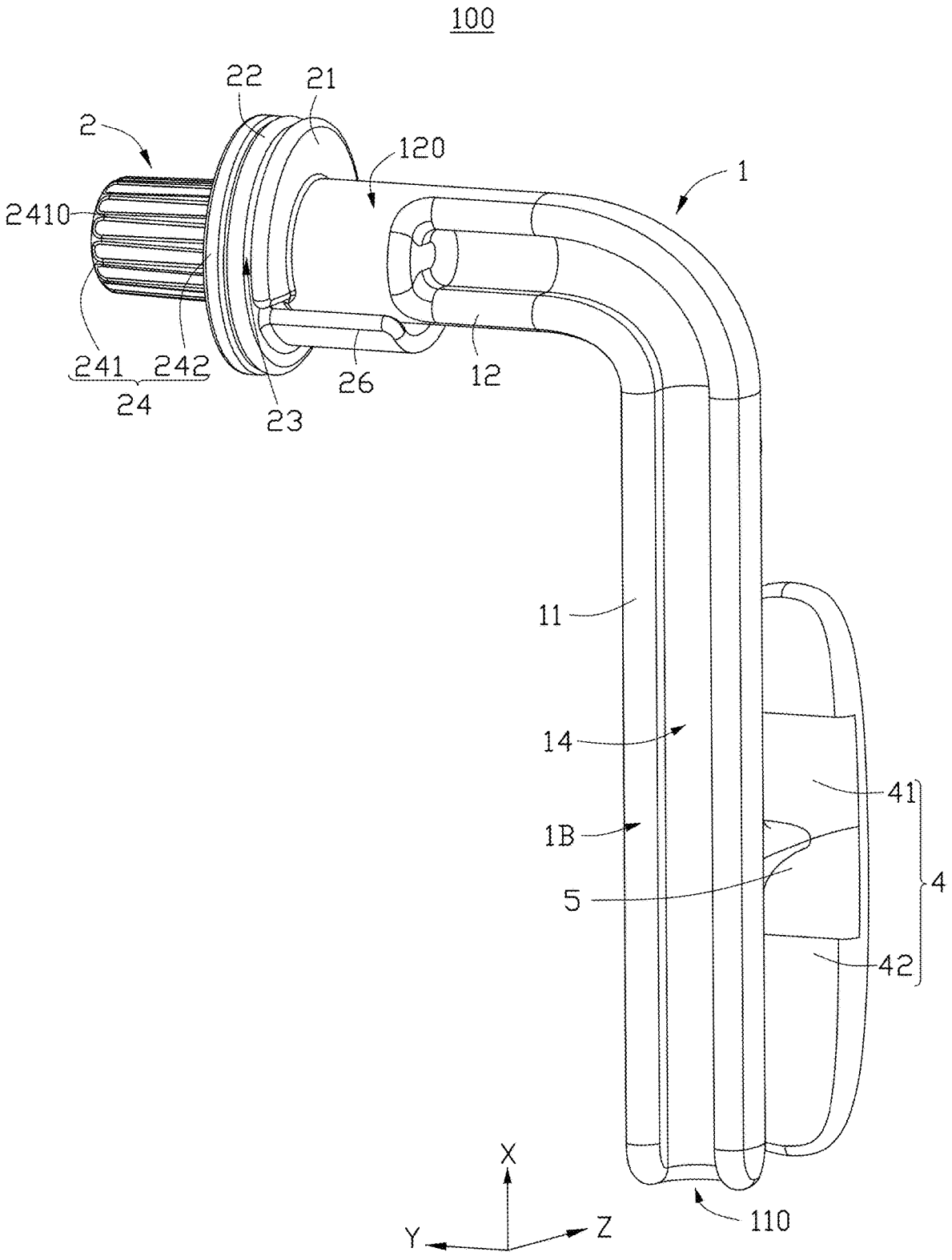
FIG. 3 is similar to FIG. 2, but showing the hand crocheting device viewed from another angle.
Figure 4:
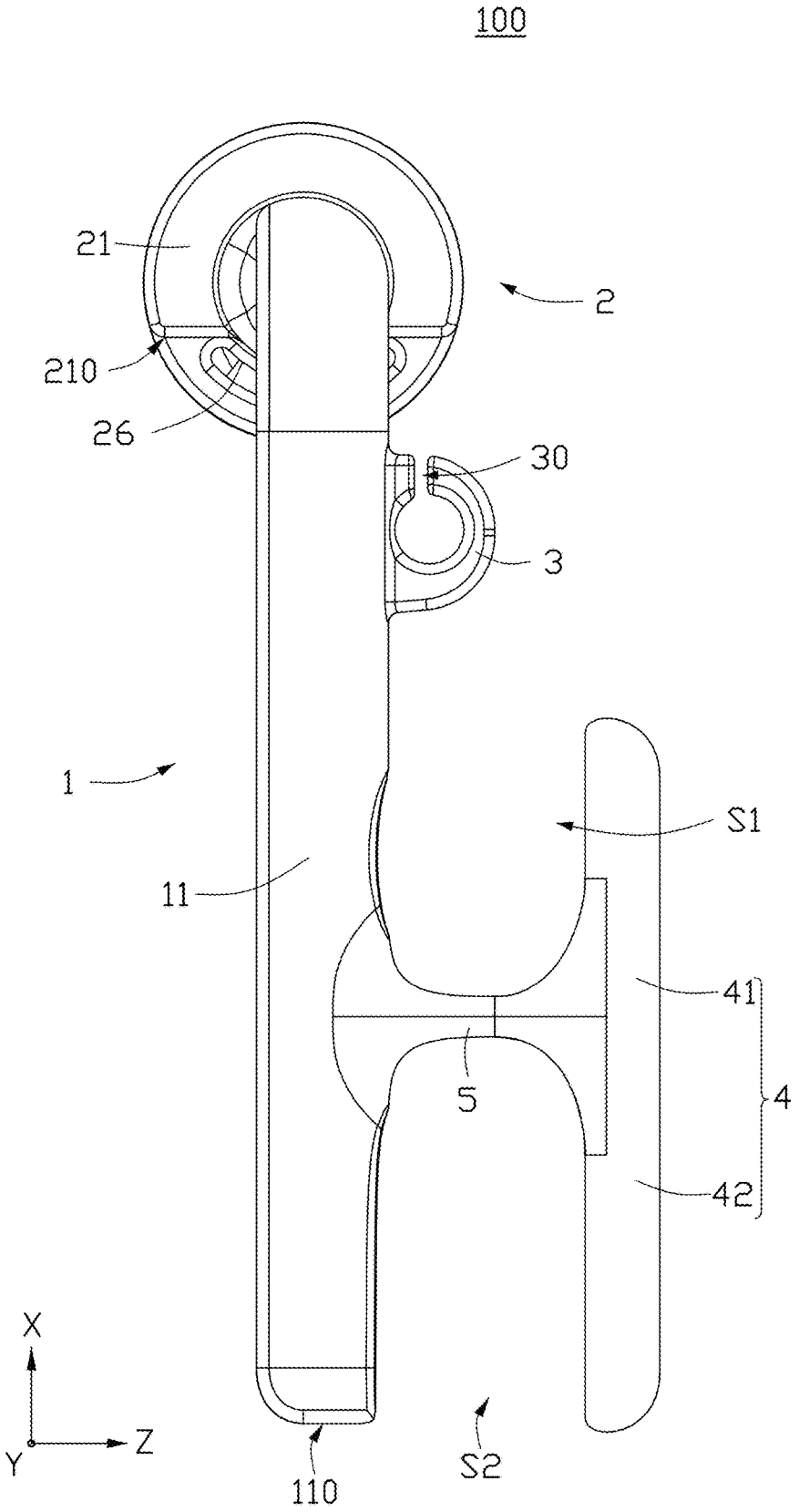
FIG. 4 is similar to FIG. 2, but showing the hand crocheting device viewed from yet another angle.

Referring to FIGS. 2 to 5, the hand crocheting device 100 may further include a handle 4, which is connected to first portion 11 of the main body 1 through a connecting portion 5. The handle 4 is connected to the first surface 1A and may extend in the first direction X. The connecting portion 5 is closer to the first end 110 of the main body 1 relative to the guiding ring 3 along the first direction X. The connecting portion 5 is connected to a substantially middle position of the handle 4, such that the handle 4 is divided by the connecting portion 5 into a first handle portion 41 and a second handle portion 42. The second handle portion 42 is closer to the first end 110 of the main body 1 relative to the first handle portion 41 along the first direction X. As shown in FIG. 4, the first handle portion 41, the main body 1, and the connecting portion 5 cooperatively define a first recess S1 for receiving the index finger. The second handle portion 42, the main body 1, and the connecting portion 5 cooperatively define a second recess S2 for receiving the middle finger. When in use, the palm of the user is placed between the main body 1 and the handle 4, with the index finger being received in the first space S1 and the middle finger being received in the second recess S2. At this time, the connecting portion 5 is located between the index finger and the middle finger. Thus, the hand crocheting device 100 may be held by the user easily, and may follow any movement of the hand during the crocheting process without affecting the tension on the yarn.

In at least one embodiment, the first surface 1A at the first portion 11 of the main body 1 is curved. Referring to FIGS. 3 and 6, the second surface 1B of the main body 1 defines a groove 14. The groove 14 may be located at the first portion 11 and extend through the first end 110 of the main body 1. The groove 14 may further be located in the second portion 12. When it is needed to make a magic circle, the yarn may be wrapped around the first portion 11 of the main body 1, and the groove 14 may receive a tip of the crocheting hook therein. The diameter of the magic circle is decided by the cross-sectional size of the first portion 11, which may improve the accuracy of the magic circle. Furthermore, the groove 14 may reduce the size and the weight of the hand crocheting device 100.

Figure 7:
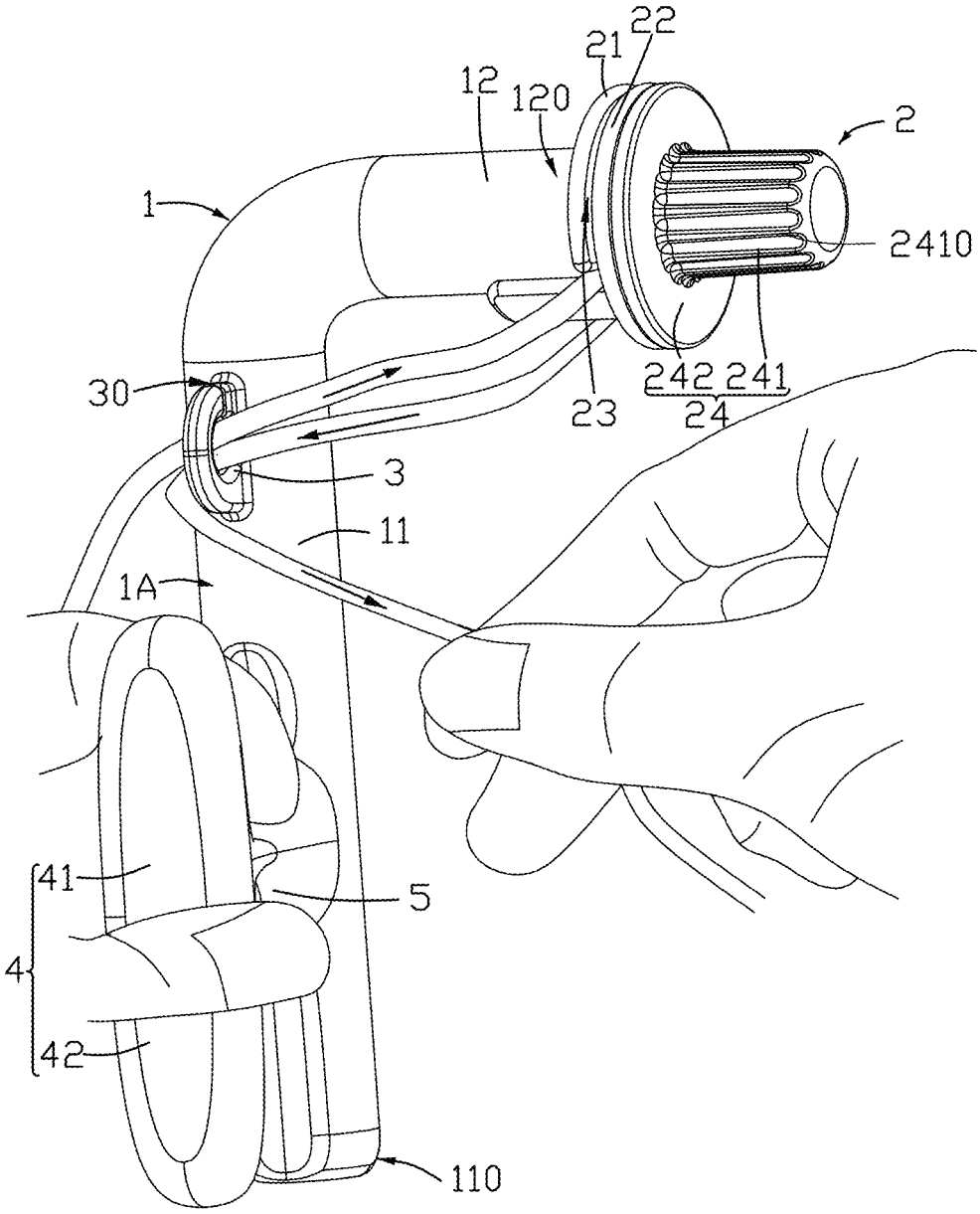
FIG. 7 is a diagrammatic view showing a yarn wrapped on the hand crocheting device shown in FIG. 2.

Referring to FIG. 7, wherein the arrows in the FIG. 7 show the running direction of the yarn. When it is needed to make a crochet chain stitch, the yarn tail sequentially extends through the guiding ring 3 and the clamping slot 23, and the yarn tail further extends through the guiding ring 3 again. Then, the palm of the user is placed between the main body 1 and the handle 4, with the index finger being received in the first recess S1 and the middle finger being received in the second recess S2. Then, the knob 24 is rotated to drive the second clamping baffle 22 to slide toward the first clamping baffle 21, thereby tightening the yarn to provide a desired tension on the yarn tail. Then, the crocheting hook is placed to be aligned with the yarn tail that extend from the guiding ring 3, thereby completing the following crocheting process. During the entire crocheting process, the hand crocheting device 100 replaces the index finger to hold and tighten the yarn.

Figure 8:
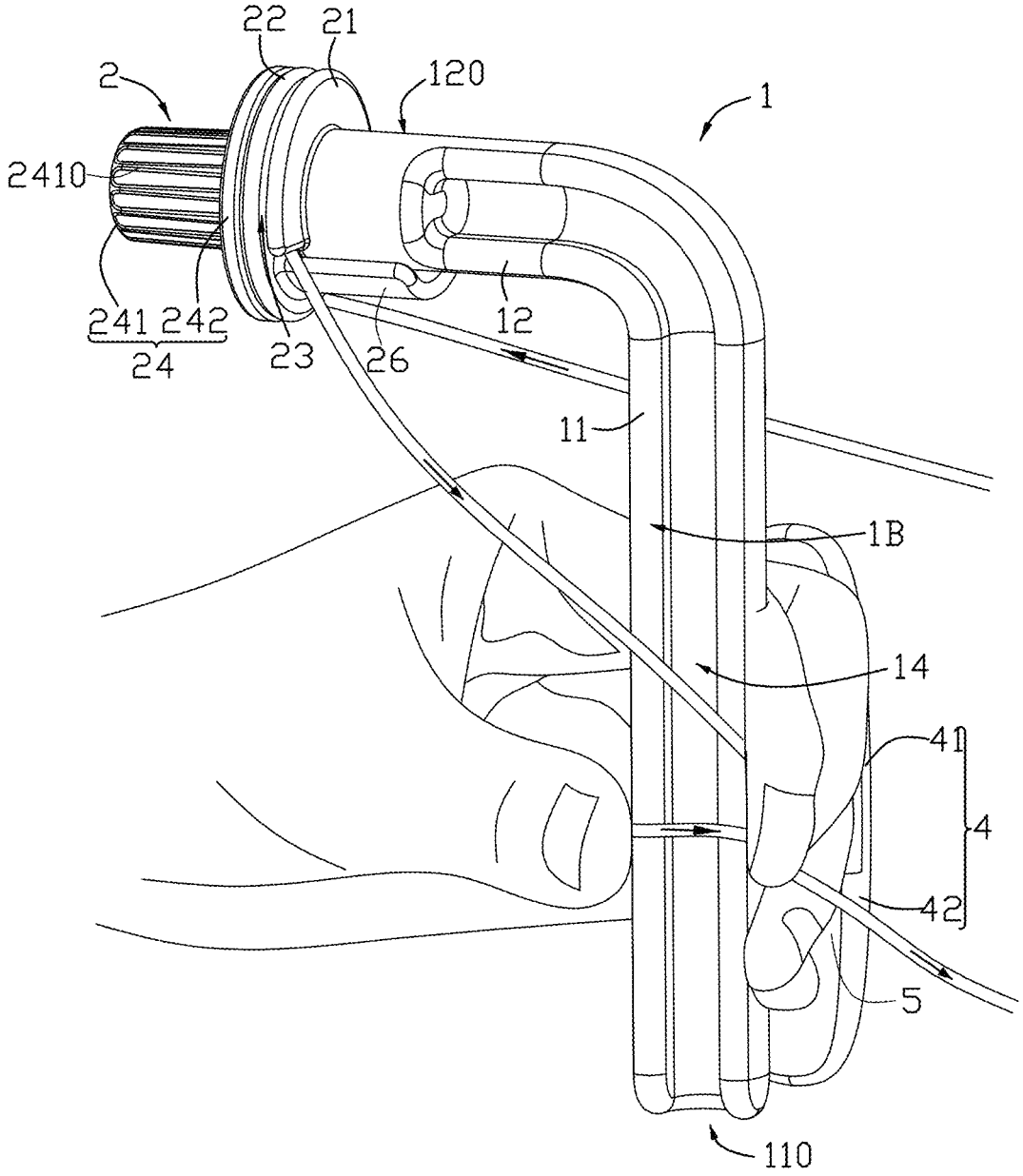
FIG. 8 is a diagrammatic view showing a yarn wrapped on the hand crocheting device shown in FIG. 3.

Referring to FIG. 8, wherein the arrows in the FIG. 8 show the running direction of the yarn. When it is needed to make a magic circle, the yarn tail sequentially extends through the guiding ring 3 and the clamping slot 23. Then, the knob 24 is rotated to drive the second clamping baffle 22 to slide toward the first clamping baffle 21, thereby tightening the yarn to provide a desired tension on the yarn tail. Then, the yarn tail at the second surface 1B of the main body 1 is further wrapped around the first portion 11 of the main body 1 to form a loop, and the crocheting hook is inserted into the loop through the groove 14 to catch the yarn (that is, the second segment of the yarn in FIG. 8 along the running direction of the yarn), thereby completing the following crocheting process. Thus, it is convenient and simple to make a magic circle, making it easier for beginners to learn how to crochet. The crocheting results of the finished product are good.

Figure 9:
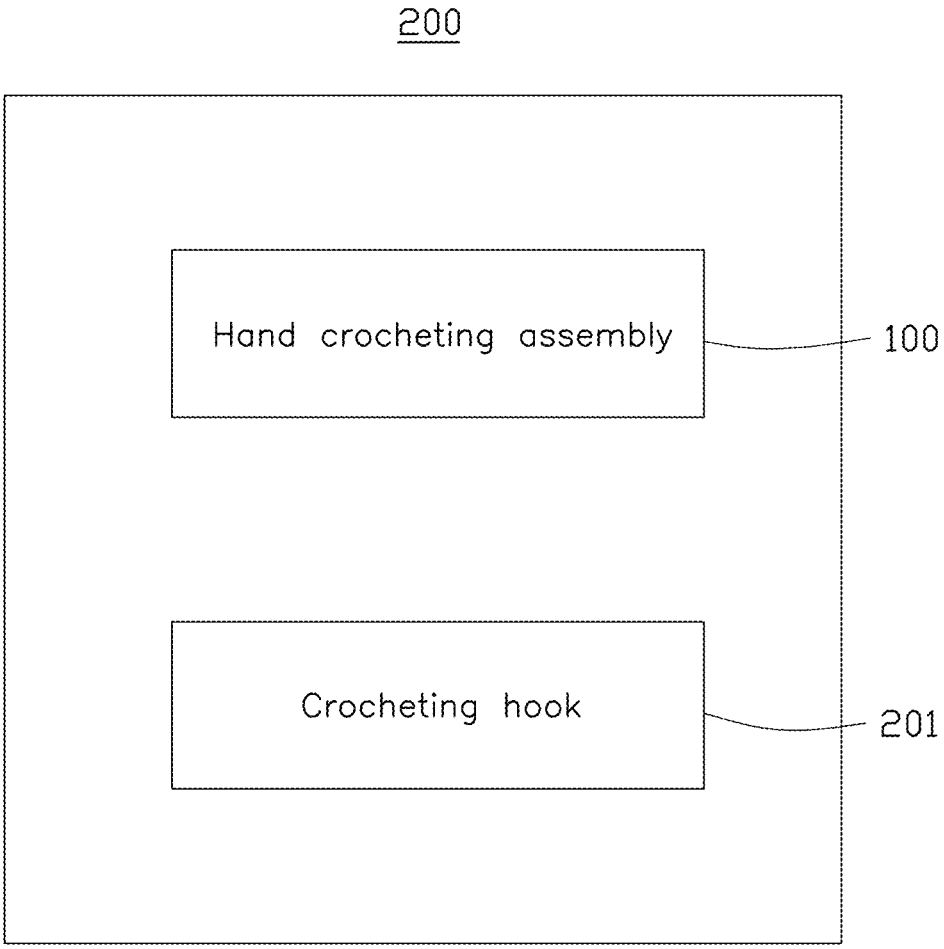
FIG. 9 is a block diagram of a hand crocheting assembly according to an embodiment of the present application.

Referring to FIG. 9, a hand crocheting assembly 200 is further provided according to an embodiment of the present application. The hand crocheting assembly 200 includes the hand crocheting device 100 mentioned above and a crocheting hook 201.

Even though information and advantages of the present embodiments have been set forth in the foregoing description, together with details of the structures and functions of the present embodiments, the disclosure is illustrative only. Changes may be made in detail, especially in matters of shape, size, and arrangement of parts within the principles of the present embodiments to the full extent indicated by the plain meaning of the terms in which the appended claims are expressed.

What is claimed is:

1. A hand crocheting device comprising:

a main body comprising a first end and a second end; and an adjusting mechanism located at the second end, the adjusting mechanism comprising a first clamping baffle fixed to the second end and a second clamping baffle facing the first clamping baffle, wherein the first clamping baffle and the second clamping baffle cooperatively define a clamping slot configured for receiving a yarn, and the second clamping baffle is movable relative to the first clamping baffle to adjust a size of the clamping slot, thereby adjusting a tension on the yarn;

wherein the main body further comprises a sleeve protruding from the second end, the second clamping baffle is configured to slide on the sleeve toward or away from the first clamping baffle, the sleeve defines a first screw thread on an inner surface of the sleeve: the adjusting mechanism further comprises a knob and a screw rod connected to the knob, the knob is arranged at a side of the second clamping baffle away from the first clamping baffle, the knob is configured to rotate relative to the second clamping baffle, the screw rod defines a second screw thread on a periphery of the screw rod, the first screw thread and the second screw thread are engaged with each other, such that the second clamping baffle slides toward or away from the first clamping baffle when the knob rotates relative to the second clamping baffle.

2. The hand crocheting device according to claim 1, wherein the knob comprises a cap portion and a plate portion connected to the cap portion, the screw rod is connected to the cap portion, the screw rod protrudes from the cap portion and the plate portion, the plate portion is configured to abut against the second clamping baffle and drive the second clamping baffle to slide toward or away from the first clamping baffle when the knob rotates relative to the second clamping baffle.

3. The hand crocheting device according to claim 2, wherein an outer surface of the knob is provided with a plurality of ribs.

4. The hand crocheting device according to claim 1, wherein the first clamping baffle defines a first cutout, the adjusting mechanism further comprises a third baffle, the third baffle is connected to a side of the second clamping baffle facing the first clamping baffle, the third baffle extends through the first cutout.

5. The hand crocheting device according to claim 1, wherein the main body is L-shaped, the main body comprises a first portion and a second portion connected to the first portion, the first portion extends along a first direction and comprises the first end, the second portion extends along a second direction perpendicular to the first direction and comprises the second end.

6. The hand crocheting device according to claim 5, further comprising a guiding ring, wherein the guiding ring is connected to the first portion.

7. The hand crocheting device according to claim 6, wherein a side of the guiding ring away from the first end defines a second cutout.

8. The hand crocheting device according to claim 6, wherein the first portion defines a groove, the main body comprises a first surface and a second surface connected to the first surface, the first surface and the second surface are opposite to each other, the guiding ring is connected to the first surface of the first portion, and the groove is located at the second surface of the first portion.

9. The hand crocheting device according to claim 8, wherein the groove is further defined in the second portion.

10. The hand crocheting device according to claim 6, wherein a surface of the hand crocheting device having the guiding ring is curved.

11. The hand crocheting device according to claim 5, further comprising a handle and a connecting portion, wherein the handle is connected to the first portion through the connecting portion, the handle is divided by the connecting portion into a first handle portion and a second handle portion, the second handle portion is closer to the first end relative to the first handle portion along the first direction; the first handle portion, the main body, and the connecting portion cooperatively define a first recess; the second handle portion, the main body, and the connecting portion cooperatively define a second recess.

12. A hand crocheting assembly comprising:

a crocheting hook; and a hand crocheting device comprising:

a main body comprising a first end and a second end; and an adjusting mechanism located at the second end, the adjusting mechanism comprising a first clamping baffle fixed to the second end and a second clamping baffle facing the first clamping baffle, wherein the first clamping baffle and the second clamping baffle cooperatively define a clamping slot configured for receiving a yarn, and the second clamping baffle is movable relative to the first clamping baffle to adjust a size of the clamping slot, thereby adjusting a tension on the yarn;

wherein the main body further comprises a sleeve protruding from the second end, the second clamping baffle is configured to slide on the sleeve toward or away from the first clamping baffle, the sleeve defines a first screw thread on an inner surface of the sleeve; the adjusting mechanism further comprises a knob and a screw rod connected to the knob, the knob is arranged at a side of the second clamping baffle away from the first clamping baffle, the knob is configured to rotate relative to the second clamping baffle, the screw rod defines a second screw thread on a periphery of the screw rod, the first screw thread and the second screw thread are engaged with each other, such that the second clamping baffle slides toward or away from the first clamping baffle when the knob rotates relative to the second clamping baffle.

13. The hand crocheting assembly according to claim 12, wherein the first clamping baffle defines a first cutout, the adjusting mechanism further comprises a third baffle, the third baffle is connected to a side of the second clamping baffle facing the first clamping baffle, the third baffle extends through the first cutout.

14. The hand crocheting assembly according to claim 12, wherein the main body is L-shaped, the main body comprises a first portion and a second portion connected to the first portion, the first portion extends along a first direction and comprises the first end, the second portion extends along a second direction perpendicular to the first direction and comprises the second end.

15. The hand crocheting assembly according to claim 14, wherein the hand crocheting device further comprises a guiding ring connected to the first portion.

16. The hand crocheting assembly according to claim 15, wherein the first portion defines a groove, the main body comprises a first surface and a second surface connected to the first surface, the first surface and the second surface are opposite to each other, the guiding ring is connected to the first surface of the first portion, and the groove is located at the second surface of the first portion.

* * * * *